US007155857B2

(12) United States Patent
Elder

(10) Patent No.: US 7,155,857 B2
(45) Date of Patent: Jan. 2, 2007

(54) ASSAULT RIFLE HAND AND FOREARM GUARD AND METHOD OF USE

(76) Inventor: Samuel F. Elder, 200 Madonna Blvd., #34, Tierra Verde, FL (US) 33715

( * ) Notice: Subject to any disclaimer, the term of this patent is extended or adjusted under 35 U.S.C. 154(b) by 249 days.

(21) Appl. No.: 10/887,403

(22) Filed: Jul. 8, 2004

(65) Prior Publication Data

US 2006/0005445 A1 Jan. 12, 2006

(51) Int. Cl.
*F42C 23/00* (2006.01)

(52) U.S. Cl. ..... 42/72

(58) Field of Classification Search ..... 42/118, 42/72; 89/36.01–36.17; D22/108
See application file for complete search history.

(56) References Cited

U.S. PATENT DOCUMENTS

| | | | | | |
|---|---|---|---|---|---|
| 295,013 | A | | 3/1884 | Hunter | |
| 683,203 | A | * | 9/1901 | Grubb | 356/251 |
| 964,570 | A | | 7/1910 | Singer | |
| 1,146,428 | A | | 7/1915 | Jacob | |
| 1,166,557 | A | | 1/1916 | Stergianopulos | |
| 1,244,679 | A | | 10/1917 | Winn, Jr. | |
| 1,273,025 | A | | 7/1918 | Brongel | |
| 1,290,606 | A | | 1/1919 | Lovas | |
| 1,301,293 | A | | 4/1919 | Molvig | |
| 1,320,888 | A | | 11/1919 | Miller et al. | |
| 1,434,044 | A | | 10/1922 | Cooke | |
| 1,555,027 | A | | 9/1925 | Rose | |
| 1,611,814 | A | | 12/1926 | Butler | |
| 2,020,702 | A | * | 11/1935 | Samuel | 2/2.5 |
| 2,215,204 | A | | 9/1940 | Young | |
| 2,306,708 | A | | 12/1942 | Mendel | |
| 2,457,755 | A | * | 12/1948 | Ugazio et al. | 42/104 |
| 2,734,425 | A | | 2/1956 | Brandt | |
| 3,370,302 | A | * | 2/1968 | Karlyn | 2/2.5 |
| 3,507,067 | A | * | 4/1970 | Into | 42/10 |
| 3,641,691 | A | * | 2/1972 | Ellis et al. | 42/105 |
| 5,293,807 | A | | 3/1994 | Hajdu | |
| 5,566,489 | A | | 10/1996 | Artman et al. | |
| 5,850,052 | A | * | 12/1998 | Gabriel | 89/36.05 |
| 6,311,424 | B1 | * | 11/2001 | Burke | 42/118 |
| 6,389,949 | B1 | | 5/2002 | Carreira | |
| 6,481,145 | B1 | * | 11/2002 | Weichert et al. | 42/105 |
| 6,543,173 | B1 | | 4/2003 | Golan | |
| 6,595,101 | B1 | | 7/2003 | Baker | |
| 6,715,227 | B1 | * | 4/2004 | Swain | 42/118 |
| 2005/0132631 | A1 | * | 6/2005 | Bodo | 42/118 |
| 2005/0217472 | A1 | * | 10/2005 | Baker | 89/36.06 |

* cited by examiner

*Primary Examiner*—Michael J. Carone
*Assistant Examiner*—John A. Radi
(74) *Attorney, Agent, or Firm*—McKee, Voorhees & Sease, P.L.C.

(57) ABSTRACT

An assault rifle with a hand and forearm guard for protection of the user's hand and forearm. The assault rifle may be aimed from the side or on top of a barrier using an optical sensing system.

15 Claims, 6 Drawing Sheets

ASSAULT RIFLE HAND AND FOREARM GUARD AND METHOD OF USE

BACKGROUND OF THE INVENTION

The present invention relates generally to firearms and specifically for protecting a user's hand and/or forearm when positioning an assault rifle beyond a barrier.

Guards have been used with firearms to protect the user from incoming fire while discharging the firearm. The guards are typically positioned at a forward end of the firearm to protect the user while firing the gun and aiming the gun using a conventional sight on the gun barrel. These devices often expose a portion of the user's face as looking down the conventional targeting sight to harm as there is no protection to the area immediately above the sight or directly surrounding the sight. Furthermore, the prior art firearm guards are large and bulky and therefore not particularly well suited for urban fire fights.

In urban fire fights, the user encounters a number of different barriers, namely horizontal and vertical barriers that provide adequate protection for the users. Using conventional firearms, a user will position themselves with a large portion of their body behind the wall and from this protective position aim their firearm. Unfortunately, a portion of the user is still exposed in this configuration, namely their torso, arms and hands.

Also in the prior art, a weapon has been developed that permits a user to remain entirely sheltered behind the building and uses a video camera for targeting a short barreled gun which can be turned at an angle to go around the building side. This product requires an entirely new gun to be purchased and issued to the users.

Accordingly, a primary objective of the present invention is to provide a hand and forearm guard that may modify an assault rifle that protects the arms, hands and forearms of a soldier positioning the gun beyond a protective surface of a building.

A further objective of the present invention is to provide an optical sighting system upon an assault rifle which permits the firearm to be aimed while beyond the barrier.

A still further objective of the present invention is an efficiently sized guard that protects the hands and forearm of the user; these two portions of the user's body being exposed when the gun is targeted beyond the protective barrier cover.

Another objective of the present invention is the provision of an assault rifle and forearm guard that is efficient in operation, economical to manufacture and durable in use.

These and other features, objectives and advantages will become apparent to those skilled in the art with reference to the accompanying specification and claims.

SUMMARY OF THE INVENTION

The foregoing objectives may be achieved using a hand and/or forearm guard on at least one of the front grip or the rear grip of an assault rifle. The hand and/or forearm guard has a hand portion that optionally attaches to the grip and extends outward to a second end sufficient to cover the hand of the user. The guard also has a forearm portion that attaches to the hand portion and expands outward to cover the user's forearm. The hand and forearm guard is designed so that the user may hold the gun across the user's arm in position for firing around a barrier without using a conventional gun sight.

An optional optical sighting system assists the user in aiming the gun as the user will not aligning their eye to the gun sight but instead will be holding it anywhere from 1° off from alignment of their body to perpendicular to their body. Typically the user, when firing around a barrier, will be aiming the gun between 30–90° around a barrier to effectively target around the barrier.

The hand and/or forearm guard may be used with or upon the front grip, the rear grip, or both the front grip and the rear grip.

According to another feature of the present invention, the hand portion is formed in unitary assembly with a grip of the assault rifle and provided as a replacement part to the user.

According to another feature of the present invention, the hand and forearm guard is positioned upon the assault rifle to permit use of the conventional sighting system of the gun.

According to another feature of the present invention, the hand and/or forearm guard is separate from the gun. It optionally may be incorporated into a glove or hand-carryable device.

The foregoing objectives may also be achieved by a hand and forearm guard that can modify an existing assault rifle. The hand and forearm guard includes a hand portion with a first end that attaches to a grip of the assault rifle and a forearm portion that is attached to the hand portion. The hand and forearm guard may include features including joining the hand portion and the forearm portion together by a moveable connection. In addition, the forearm portion may include a first section and a second section which permits some flexing such that the user may manipulate the angle the rifle is at beyond the barrier.

The foregoing objectives may also be achieved by a method of using an assault rifle with a hand and forearm guard for firing around a barrier. The method comprising the steps of holding the assault rifle across a user's arms, positioning the user's arms behind a hand and forearm guard and extending the assault rifle and the user's arms, protected behind the hand and forearm guard, beyond the barrier. Additionally, the method may include the step of using an optical sighting system for aiming the assault rifle once beyond the barrier.

DETAILED DESCRIPTION OF THE EXEMPLARY EMBODIMENTS

Figure 1:
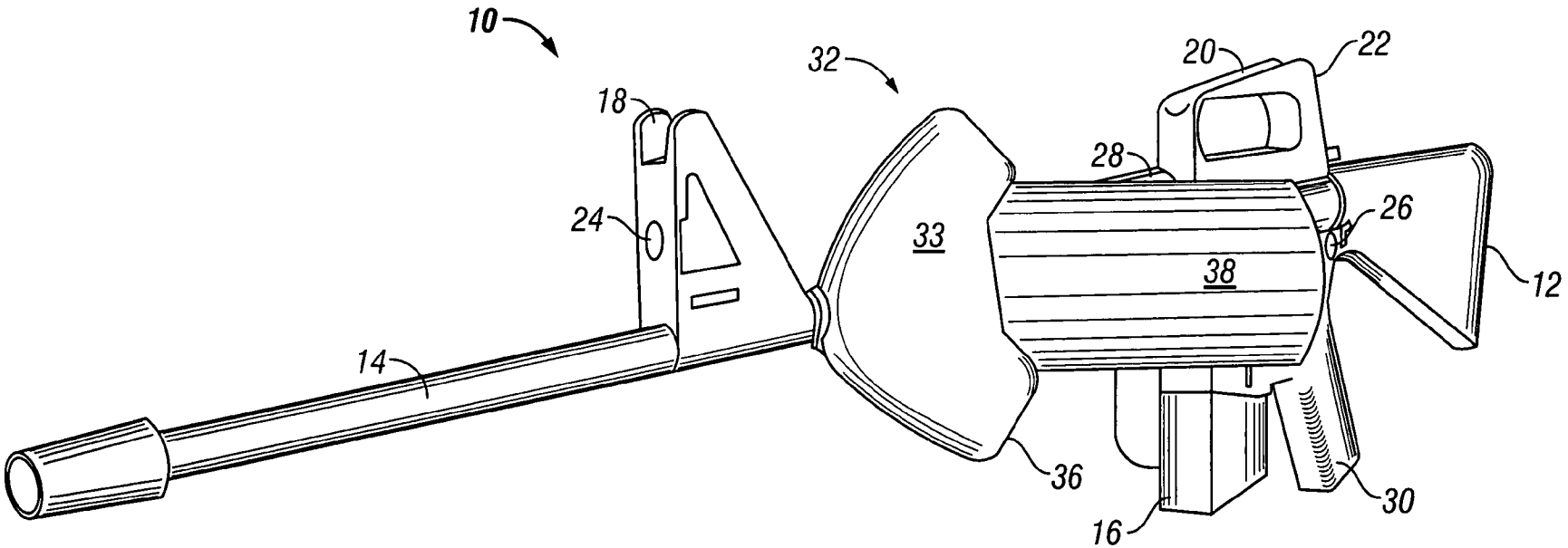
FIG. 1 is a front perspective view of an assault rifle having a hand and forearm guard positioned for the left hand behind the conventional sight.

An assault rifle having a hand and forearm is generally designated in the drawings by the reference numeral 10. Although generally referred to by the term assault rifle, it is to be understood that the hand and forearm guard may apply to other firearms.

The assault rifle 10 includes a stock 12 and a barrel 14. The conventional firearm has the barrel 14 in alignment with the stock 12 and does not pivot relative to the other portion of the firearm. The assault rifle 10 also has a magazine 16 for holding ammunition, a front sight 18 and a rear sight 20 that may be built into a handle 22 of the gun. In this conventional layout, the ammunition is fired after aiming the gun by placing the stock 12 upon the user's shoulder and the user's eye adjacent the rear sight 20. The user then aligns the front and the rear sights for targeting. Alternatively, an optical sight 24 may be used that is viewed by the user by a display screen typically in the user's helmet. The user's video display screen is connected to the optical sensing system 24 by a video jack 26.

The assault rifle has a front grip or barrel grip 28 and a rear grip or pistol grip 30.

As illustrated in FIG. 1, a hand and/or forearm guard is labeled 32. The guard 32 may be attached adjacent the front grip, the rear grip, or both. The guard 32 is attached at a first end and has a hand portion 33 and a forearm portion 38. The hand portion 33 is typically a conical section but may take other forms that resemble a fencing guard (as in FIG. 2), a rectangular plate (as in FIG. 4B and 5B), a cylindrical section or other shapes that covers the hand.

The forearm portion 38 is attached to the hand portion 33. The forearm portion 38 may be a cylindrical segment or other shaped segment that adequately protects the forearm from incoming projectiles or bullets.

Figure 2:
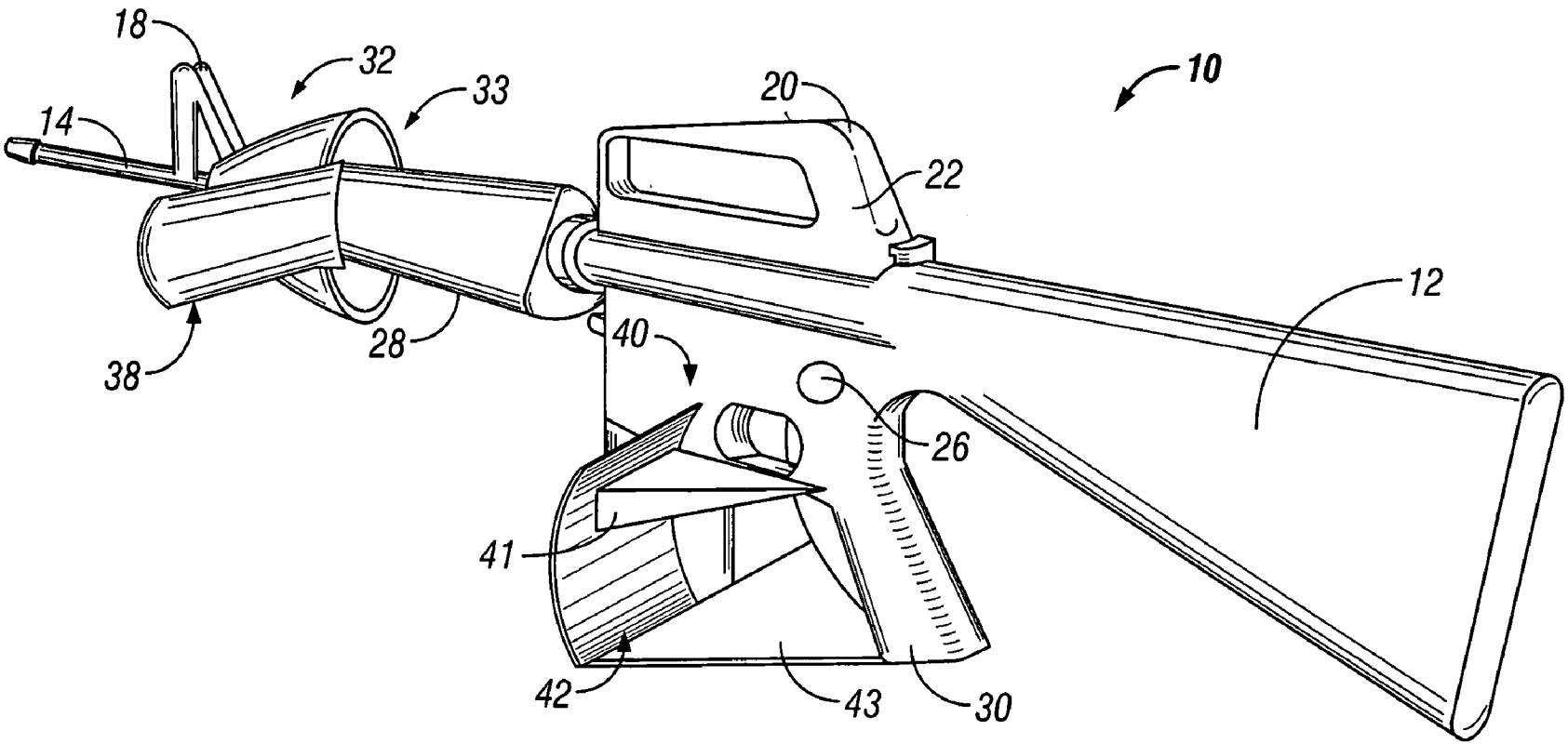
FIG. 2 is a rear perspective view of an assault rifle with a hand and forearm guard attached to the front hand grip of the assault rifle and a hand and forearm guard attached to the rear hand grip of the assault rifle.

As seen in FIG. 2, the assault rifle 10 is shown having a guard 32 at the front of the gun 10 and a rear guard 40. The rear guard 40, similar to the front guard 32, protects the user by utilizing a hand portion 42. The rear guard 40, as illustrated in FIG. 2, is connected to the rear grip 30 by an upper support 41 that extends from below the trigger to the hand portion 42 and by a bottom plate 43 that extends from below the pistol grip 30 to the hand portion 42. The upper support 41 and the bottom plate 43 provide rigidity to the structure and maintains the hand portion 42 stationary. Alternatively, the rear guard 40 may be incorporated onto the front grip 28 and/or modified to include a pistol type grip below the front grip 28.

Figure 3:
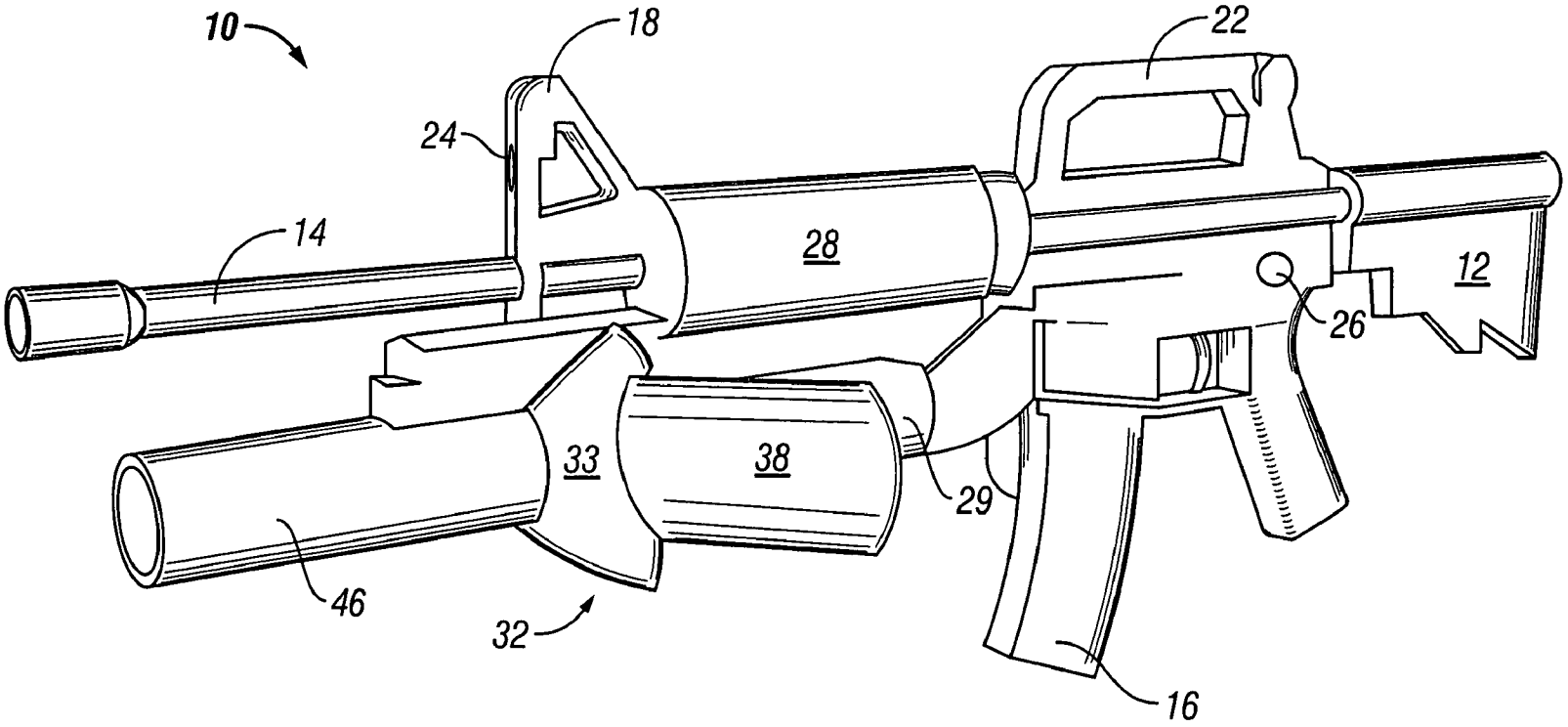
FIG. 3 is a front perspective view of an assault rifle with a grenade launcher having the hand and forearm guard attached to the grenade launcher.

As seen in FIG. 3, the hand and/or forearm guard 32 may be attached to grenade launcher 46 underneath the barrel 14 of the assault rifle 10. In the illustrated scenario, the guard 32 has been moved because the user grips the grenade launcher 46 as opposed to the forward grip 28. The guard 32 may be attached directly to the grenade launcher 48 or a grenade launcher grip 29. Alternatively, the guard 32 may be formed in unitary assembly with the grenade launcher hand grip 29 and replace the existing hand grip on the grenade launcher.

Figure 4A:
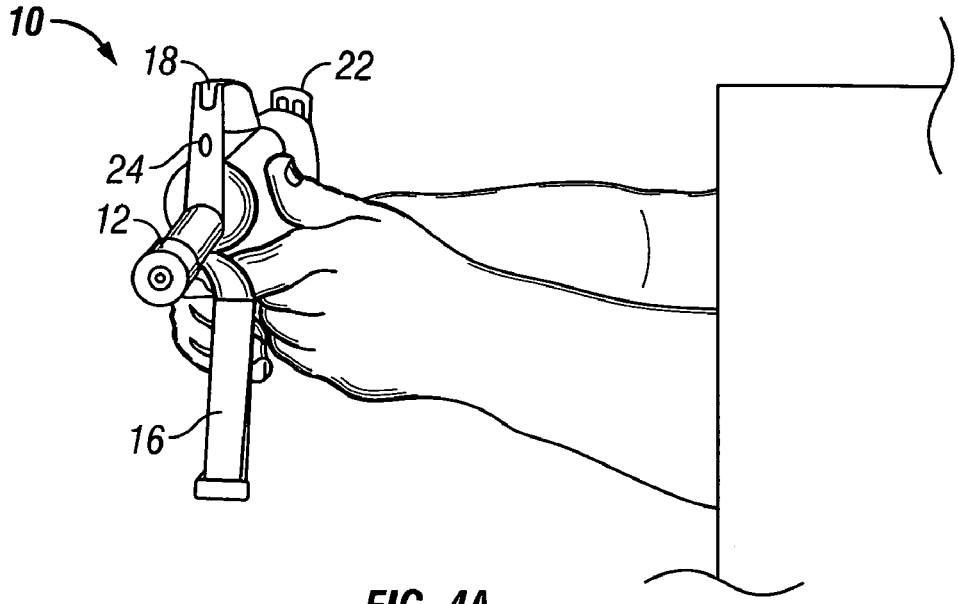
FIG. 4A is a front view of an assault rifle positioned by a user from the side of a barrier.
Figure 4B:
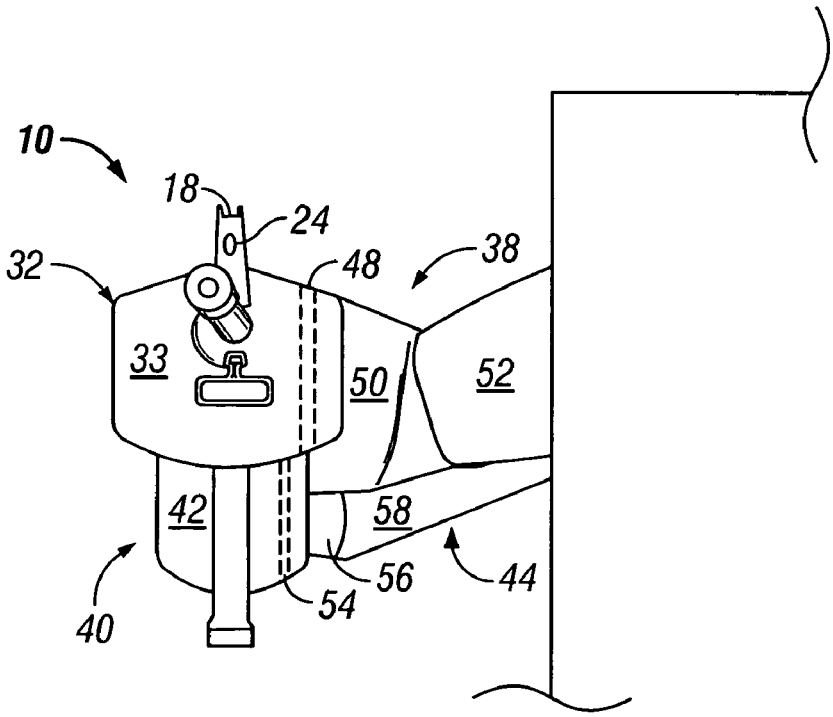
FIG. 4B is a front view of an assault rifle positioned by a user from the side of a barrier using the hand and forearm guard of the present invention.

FIG. 4A demonstrates the user positioning a conventional gun for firing to the side of a barrier. The hands and forearm are completely unprotected in this fashion, yet the remainder of the user remains safe behind the barrier. FIG. 4B illustrates an embodiment of a front guard 32 and a rear guard 40 that completely protects the hands and forearms of the user. The front guard 32, as seen in FIG. 4B has a hand portion 33 and a forearm portion 38. The forearm portion 38 is attached to the hand portion 33 by a connecting member 48. The connecting member 48, as illustrated, is a channel which slidingly receives a mating rod upon the forearm portion 38. The forearm portion may have two sections 50, 52 joined together by a pivoting connection that may be a hinge to promote mobility. The guards 32, 40, as illustrated, permit the angle of firing to be adjusted easily by the user moving their hands and forearms.

The rear guard 40 has a hand portion 42 and a forearm portion 44. The forearm portion 44 is affixed to the hand portion 42 by connecting member 54. The connecting member 54, as illustrated, is a channel which slidingly receives a mating rod upon the forearm portion 44. The forearm portion 44 having a first section 56 and a second section 58 joined by a pivotal connection that may be a hinge.

Figure 5A:
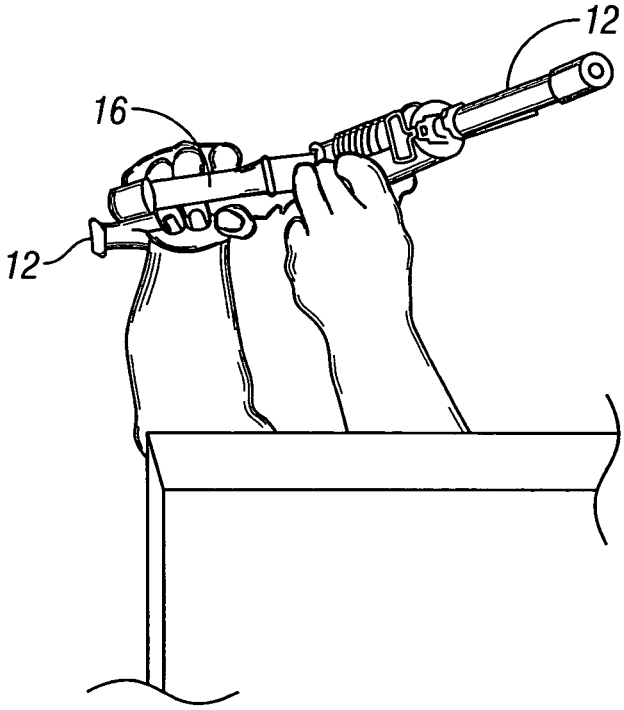
FIG. 5A is a perspective view of an assault rifle positioned by a user above the side of a barrier.
Figure 5B:
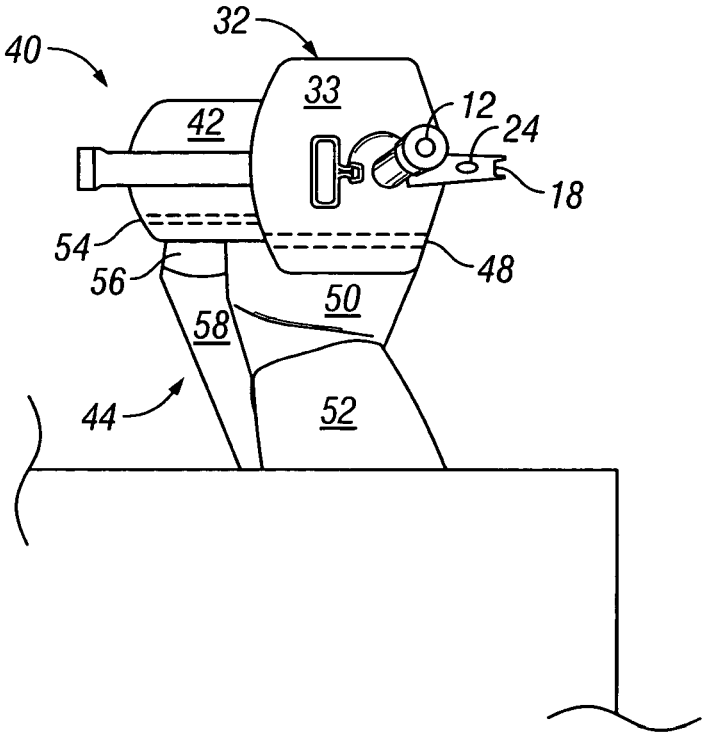
FIG. 5B is a perspective view of an assault rifle positioned by a user above the side of a barrier using the hand and forearm guard of the present invention.

FIG. 5A illustrates the user firing a conventional gun over a barrier and exposing their hands and forearms to injury. As seen in FIG. 5B the injury is prevented by using a front guard 32 and rear guard 40.

Figure 6:
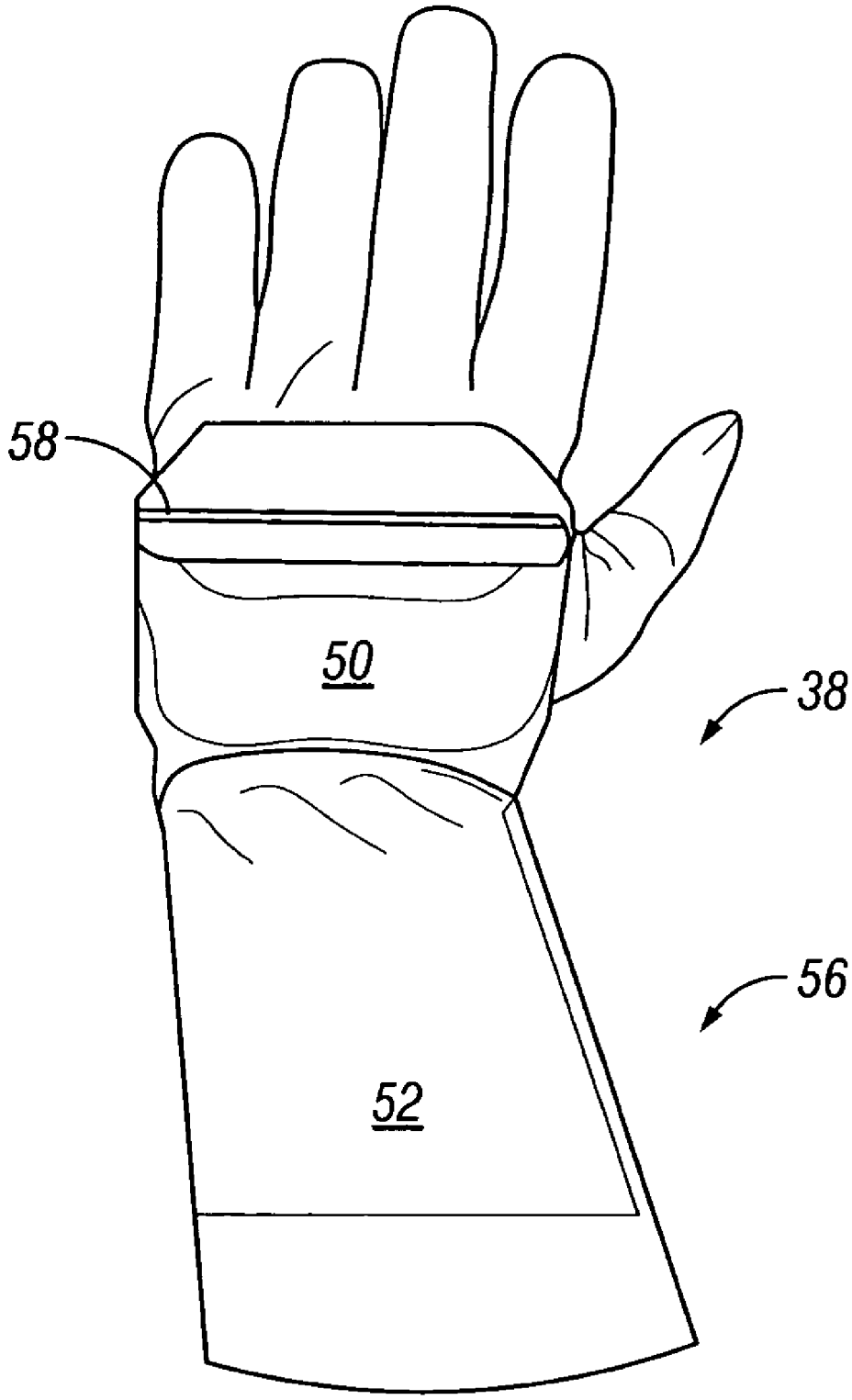
FIG. 6 is a top view of a forearm guard in use with a glove.

FIG. 6 illustrates a forearm guard 38 attached to a glove 56. The first section 50 having a rod member 58 that connects with channel 48 upon the hand portions 33, 42. The user puts the glove on his/her hand and then places the rod 49 into a receiving channel 48 on the forearm guard.

In use, the user holds the assault rifle 10 away from the body at an angle. This is in contrast to normal operation of a firearm in which the user places the user's head in alignment with the gun for sighting. In contrast, using the assault rifle with hand and forearm guards, the user can hold the gun at an angle ranging from 0° to over 90° from conventional holding position and still maintain protection of the hand and forearms. The user positions his/her arms behind the hand and forearm guards and then extends the rifle beyond a barrier for discharging the firearm 10.

The user may also aim the firearm 10 by using an optical sighting system 24. The guard operates to protect the user's hand and forearm when held through a variety of angles up to and including perpendicular to the user's body.

The guards may be made out of a variety of different materials including Kevlar®, metal, or other projectile deflectant materials.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A firearm with a hand and forearm guard comprising:

a firearm having a front grip and a rear grip;

a hand and forearm guard attached at or adjacent to at least one of the front grip or the rear grip;

the guard having a hand portion that has a first end that attaches to the firearm and extends outward to a second end to protectively cover a user's hand;

the guard having a forearm portion that has a first end attached to the hand portion and extends outward to a second end to protectively cover a user's forearm wherein the forearm portion is moveably connected to the hand portion to maintain protection of the user's forearm and the forearm portion is attachable to the user's forearm such that movement of the user's forearm adjusts an angle between the hand portion and the forearm portion;

the hand and forearm guard protecting the user's hand and forearm including when the firearm is being held across the user's arms in position for firing around a barrier without aiming using a conventional gun sight.

2. The firearm of claim 1 wherein the front grip is a barrel grip.

3. The firearm of claim 1 wherein the rear grip is a pistol grip.

4. The firearm of claim 1 wherein the hand portion is a conical segment.

5. The firearm of claim 1 wherein the forearm portion is a cylindrical segment.

6. The firearm of claim 1 wherein the hand and forearm guard is formed in one piece with at least one of the front grip or the rear grip.

7. The firearm of claim 1 wherein the hand and forearm guard protect the user's hand and forearm when being fired with either the right hand or the left hand on the front grip.

8. The firearm of claim 1 wherein the rifle has an optical sighting system which permits the user to aim the gun without positioning an eye along the gun barrel.

9. The firearm of claim 1 wherein the hand portion is attached upon the front grip behind a conventional gun sight.

10. The firearm of claim 1 wherein the hand portion is attached forward the rear grip.

11. A hand and forearm guard for an assault rifle, the guard comprising:

a guard having a hand portion with a first end that attaches to a grip of an assault rifle and extends outward to a second end to protectively cover a user's hand;

the guard having a forearm portion that has a first end attached to the hand portion and extends outward to a second end to protectively cover a user's forearm wherein the forearm portion is moveably connected to the hand portion to maintain protection of the user's forearm and the forearm portion is attachable to the user's forearm such that movement of the user's forearm adjusts an angle between the hand portion and the forearm portion;

the guard adapted to protect the user's hand and forearm including when the gun is in position for firing around a barrier.

12. The guard of claim 11 further comprising a front grip for an assault rifle joined in unitary assembly with the hand portion.

13. The guard of claim 11 further comprising a rear grip for an assault rifled joined in unitary assembly with the hand portion.

14. The guard of claim 11 wherein the guard is adapted to be attached to a grenade launcher grip attached below the location of the front grip.

15. The guard of claim 11 wherein the forearm portion has a first section pivotally connected to a second section.

* * * * *